US007130563B2

(12) United States Patent
Hara

(10) Patent No.: US 7,130,563 B2
(45) Date of Patent: Oct. 31, 2006

(54) APPARATUS FOR PRODUCING IMAGES

(75) Inventor: Kazuhiro Hara, Shizuoka-Ken (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/083,279

(22) Filed: Mar. 18, 2005

(65) Prior Publication Data

US 2006/0210312 A1 Sep. 21, 2006

(51) Int. Cl.
*G03G 15/02* (2006.01)
*G03G 15/00* (2006.01)

(52) U.S. Cl. ..... 399/116; 399/167

(58) Field of Classification Search ..... 399/167, 399/116, 121; 74/413, 421 A, 414
See application file for complete search history.

(56) References Cited

U.S. PATENT DOCUMENTS

| | | | | |
|---|---|---|---|---|
| 5,428,426 | A * | 6/1995 | Inomata et al. | 399/167 |
| 6,556,799 | B1 | 4/2003 | Saito | |
| 6,708,013 | B1 * | 3/2004 | Nomura | 399/167 |
| 2003/0068177 | A1 * | 4/2003 | Kitayama | 399/167 |
| 2004/0101328 | A1 * | 5/2004 | Kimura et al. | 399/116 X |

FOREIGN PATENT DOCUMENTS

| | | | |
|---|---|---|---|
| JP | 9-222826 | A | 8/1997 |
| JP | 2002-161945 | A | 6/2002 |

* cited by examiner

*Primary Examiner*—David M. Gray
*Assistant Examiner*—Erika J. Villaluna
(74) *Attorney, Agent, or Firm*—Foley & Lardner LLP

(57) ABSTRACT

An apparatus for producing images of the invention improves the driving accuracy of an intermediate transfer belt and a photoreceptor drum and synchronizes variations in revolving speed of the intermediate transfer belt and the photoreceptor drum, thereby effectively holding down generation of jitter.

In the apparatus for producing images, the intermediate transfer belt of the intermediate transfer unit and the photoreceptor drum are driven by a drive motor via single system reduction gear mechanism, and a belt drive gear for driving the intermediate transfer belt and a drum drive gear for driving the photoreceptor drum are meshed with each other. A drum drive shaft for driving the photoreceptor drum preferably includes the drum drive gear and a flywheel. The photoreceptor drum is set to the downstream side of a multi-speed reduction gear train which constitutes the single system reduction gear mechanism with respect to the intermediate transfer belt.

10 Claims, 6 Drawing Sheets

APPARATUS FOR PRODUCING IMAGES

BACKGROUND OF THE INVENTION

1. Technical Field of the Invention

The present invention relates to a technique for producing images used for electrophotographic digital copying machines or color printers and, more specifically, to an apparatus for producing images in which a driving accuracy of a photoreceptor drum and an intermediate transfer belt is improved and variations in revolving speed of these two parties are synchronized to improve a color matching accuracy.

2. Related Art

A technique of producing images applied to an MFP (Multi-Function Peripherals) apparatus of an intermediate transfer system is disclosed in Japanese Unexamined Patent Application Publication No. 9-222826 as an apparatus for producing images in the related art.

In this apparatus for producing images, resonance frequency oscillations of a drive system of a revolving body drive unit such as a photoreceptor drum are attenuated by a flywheel provided on a drive shaft of the photoreceptor drum.

The apparatus for producing images in the related art is generally provided with a revolving body drive unit 1 having a common drive motor as shown in FIG. 6. The revolving body drive unit 1 interlocks a motor output shaft 2*a* of a drive motor 2 with a belt drive shaft 4*a* of an intermediate transfer belt 4 via two-stage reduction gear train 3, and interlocks the motor output shaft 2*a* of the drive motor 2 with a drum drive shaft 5*a* of a photoreceptor drum 5 via a three-stage reduction gear train 6, so that the intermediate transfer belt 4 and the photoreceptor drum 5 are driven by the common drive motor 2. In other words, the revolving body drive unit 1 in the related art drives the intermediate transfer belt 4 and the photoreceptor drum 5 separately and independently.

In FIG. 6, reference numeral 7 designates a primary transfer unit and reference numeral 8 designates a secondary transfer unit. In FIG. 6, chain lines designate pitch circles of respective gears which constitute two-system multi-speed reduction gear trains 3, 6, respectively.

Therefore, variations in revolving speed of the intermediate transfer belt 4 and the photoreceptor drum 5 are not synchronized due to their individual driving, whereby there is a risk of generating jitter at a primary transfer position.

Although a motor drive force from the drive motor 2 is transmitted to a drive roller 4*a* of the intermediate transfer belt 4 via independent two-stage reduction gear train, since the belt drive system of the photoreceptor drum 5 and the drum drive system of the intermediate transfer belt 4 are independent from each other, the belt drive system is not affected by inertia of the flywheel, and hence the inertia moment is small. Therefore, the intermediate transfer belt 4 has a weakness for (has a tendency to follow) variations in load from the outside, is likely to cause unevenness of revolution, and is likely to generate the jitter. The term "jitter" means such phenomenon as drifting or unevenness (shading) of color due to fine variations in speed or unevenness of revolution of the intermediate transfer belt.

SUMMARY OF THE INVENTION

In view of such circumstances as described above, it is an object of the present invention to provide an apparatus for producing images in which a driving accuracy of a photoreceptor drum and an intermediate transfer belt is improved and behaviors of these two parties are synchronized to improve a color matching accuracy.

In order to achieve the object described above, the apparatus for producing images according to the invention includes: a photoreceptor drum having a drum surface on which electrostatic latent images are produced; a developing unit for developing the electrostatic latent images on the photoreceptor drum by predetermined toner; a primary transfer unit for transferring a toner image produced on the photoreceptor drum; an intermediate transfer unit having an intermediate transfer belt on which a transferred toner image is produced by the primary transfer unit; a secondary transfer unit for transferring the transferred toner image produced on the intermediate transfer belt to a recording medium; and a revolving body drive unit for driving the intermediate transfer belt and the photoreceptor drum from the drive motor via single system of reduction gear mechanism, and the revolving body drive unit includes a drum drive gear for rotating the photoreceptor drum and a belt drive gear for driving the intermediate transfer belt meshed with each other and the drive motor is interlocked with one of the drum drive gear and the belt drive gear.

In order to achieve the object described above, the apparatus for producing images according to the invention includes: a photoreceptor drum having a first gear on a drum revolving shaft; an intermediate transfer belt for receiving a toner image produced on the photoreceptor drum transferred thereto and holding the toner image; a drive roller for driving the intermediate transfer belt and having a second gear on a roller revolving shaft; a drive motor having a third gear on a motor revolving shaft; and a fourth gear for transmitting an output from the drive motor to the second gear by the third gear, and the first gear and the second gear are directly meshed with each other.

DETAILED DESCRIPTION OF PREFERRED EMBODIMENTS

Referring to the attached drawings, a preferred embodiment of an apparatus for producing images according to the invention will be described.

Figure 1:
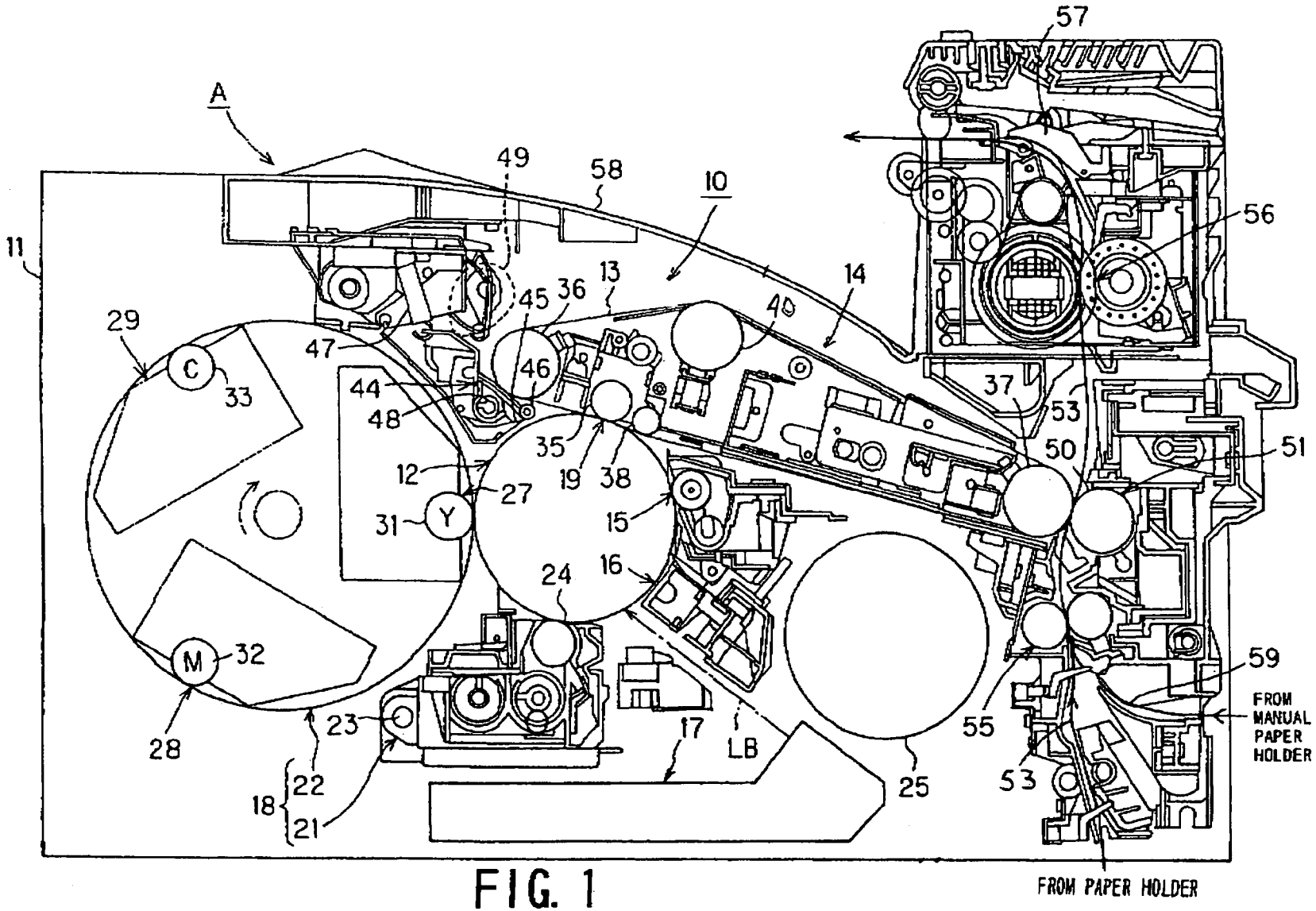
FIG. 1 is a cross-sectional view of an MFP apparatus of an intermediate transfer system provided with an apparatus for producing images according to an embodiment of the invention.

The apparatus for producing images according to the invention is provided in a printer section of the MFP apparatus or the like of an intermediate transfer system such as electrophotographic digital copying machines. An example in which an apparatus for producing images 10 according to the invention is applied to the MFP apparatus A of the intermediate transfer system is shown in FIG. 1.

The MFP apparatus A includes the apparatus for producing images 10 stored in the printer section of a body casing 11. The apparatus for producing images 10 includes a rotatably supported photoreceptor drum 12 and an intermediate transfer unit 14 provided with an intermediate transfer belt 13. The photoreceptor drum 12 and the intermediate transfer unit 14 constitute a unit, and the unit can be drawn out from the front side of the body casing 11 of the apparatus for producing images 10.

Disposed around the photoreceptor drum 12 are a drum cleaning unit 15, a charging unit 16, a laser optical unit 17, a developing unit 18 and a primary transfer unit 19. The drum cleaning unit 15 cleans the surface of the photoreceptor drum 12 and, on the other hand, the charging unit 16 charges the cleaned drum surface uniformly at a predetermined potential. The laser optical unit 17 produces an electrostatic latent image on the uniformly charged drum surface by irradiating a laser beam LB. The developing unit 18 develops the produced electrostatic latent image and produces a toner image. The primary transfer unit 19 transfers the produced toner image to the intermediate transfer belt 13.

The developing unit 18 includes a developing unit 21 for black (Bk) toner and a rotary type developing unit 22 for color toner independently. The developing unit 21 for black toner includes a magnet roller 24 which rotates about a supporting point 23 of rotation and feeds toner to the drum surface. The developing unit 21 for black toner gets a supply of black toner from a black toner bottle 25 via a toner feed path, not shown. Since the black toner is used more than the color toner, the developing unit 21 for the black toner is independent from the developing unit 22 for the color toner.

In the rotary type developing unit 22, developers 27, 28, 29 of yellow (Y), magenta (M), and cyan (C) are disposed at center angles of 120° so as to be capable of intermittent rotation for example clockwise. The developers 27 to 29 of the respective color toners include specific magnet rollers 31, 32, 33, respectively.

The developing unit 18 supplies toner of a predetermined color (Bk, Y, M and C) to the electrostatic latent image produced on the drum surface of the photoreceptor drum 12, and produces a toner image of a predetermined color on the drum surface.

The toner image is sent to a transfer position on the primary transfer unit 19 by the rotation of the photoreceptor drum 12, and is transferred onto the intermediate transfer belt 13 at this primary transfer position by a transfer bias of a transfer roll 35. The transfer process is repeated for each color and a full color transferred toner image is produced on the intermediate transfer belt 13.

The intermediate transfer belt 13 of the intermediate transfer unit 14 is wound around a drive roll 36, the transfer roll 35, a winding roll 38, a driven roll 37, and a tension roll 40.

The intermediate transfer belt 13 is driven to travel counterclockwise in FIG. 1. A belt tension during travel is adjusted by the tension roll 40, and a contact force of the intermediate transfer belt 13 to the photoreceptor drum 12 is adjusted by the winding roll 38. The winding roll 38 is adjusted so as to secure a large amount of transfer nip by winding the intermediate belt 13 towards the photoreceptor drum 12.

Provided between the drive roll 36 and the primary transfer roll 35 is a belt cleaning unit 44. The belt cleaning unit 44 includes a cleaning blade 45 which circumscribes the intermediate transfer belt 13 rotatably supported about a supporting point 46. The cleaning blade 45 is resiliently pressed into contact with the intermediate transfer belt 13 by a spring force of a spring member 47, and the toner on the intermediate transfer belt 13 is removed by cleaning, and waste toner removed therefrom is transferred to a waste toner box (not shown) by a waste toner transporting means 48 such as a spiral shaft or the like.

The belt cleaning unit 44 is provided with a cam mechanism 49 for bringing the cleaning blade 45 apart from the intermediate transfer belt 13 against a spring force of the spring member 47. This cam mechanism 49 moves the cleaning blade 45 apart from the intermediate transfer belt 13 when producing the transferred toner image, and keeps its non-contact state.

The driven roll 37 of the intermediate transfer belt 13 and a secondary transfer roll 50 opposing thereto constitute a secondary transfer unit 51. The secondary transfer unit 51 transfers the toner image on the intermediate transfer belt 13 to a transfer paper.

The secondary transfer roll 50 of the secondary transfer unit 51 is provided so as to be capable of coming into and out of contact with the driven roll (idler roll) 37 of the intermediate transfer belt 13, and at the time of secondary transfer of the toner image, the secondary transfer roll 50 circumscribes with the intermediate transfer belt 13. On the other hand, when the toner image is overlapped with the intermediate transfer belt 13, the secondary transfer roll 50 is moved apart from the intermediate transfer belt 13. Since the secondary transfer roll 50 moves apart from the intermediate transfer belt 13, the toner image on the intermediate transfer belt 13 is prevented from being disarranged by overlapping operation.

The transfer paper to which the toner image on the intermediate transfer belt 13 is transferred is taken out from a paper feed cassette stored in the lower portion of the body casing 11, and is fed along a traveling path 53. The traveling path 53 is provided with a resist roller 55 for controlling the orientation of the transfer paper and deciding on the timing of feeding of the transfer paper to the secondary transfer unit 51, the secondary transfer unit 51 for carrying out secondary transfer of the toner image to the transfer paper, a fixing unit 56 for fixing the secondarily transferred toner image, and a guiding gate 57 in sequence. The transfer paper on which the secondarily transferred toner images are fixed by the fixing unit 56 is discharged from the traveling path 53 onto a paper discharge tray 58, and accumulated thereon. The paper discharge tray 58 is formed on top of the body casing 11.

On the other hand, feeding of the transfer paper as recording medium can be carried out not only from the paper feeding cassette, but also from a manual paper feeding tray, not shown. Paper fed from the manual paper feeding tray is passed through a paper feeding guide path 59 and is guided toward the traveling path 53 before the resist roller 55.

Figure 2:
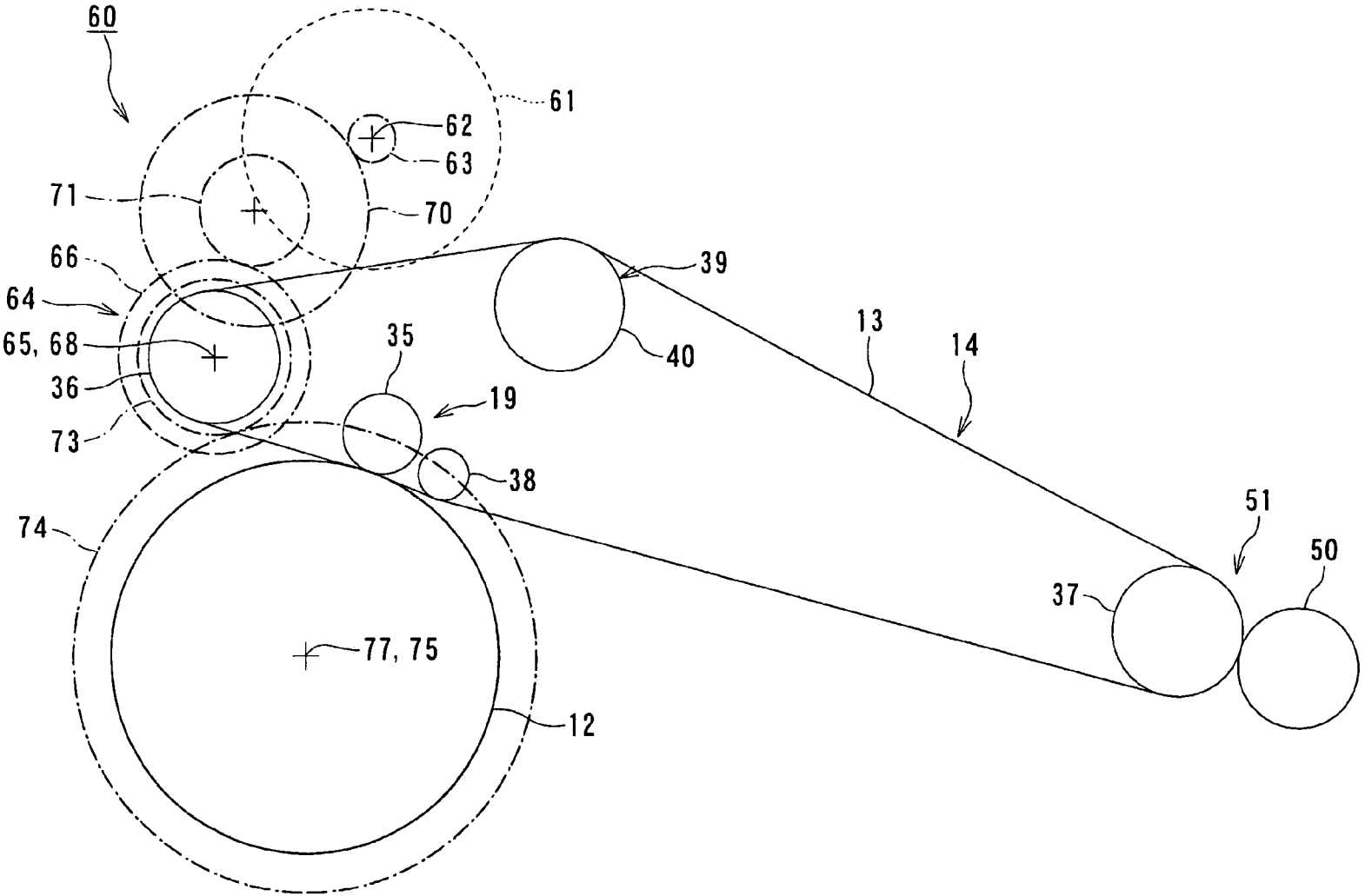
FIG. 2 is a schematic drawing of a revolving body drive unit provided in the apparatus for producing images according to the invention.
Figure 3:
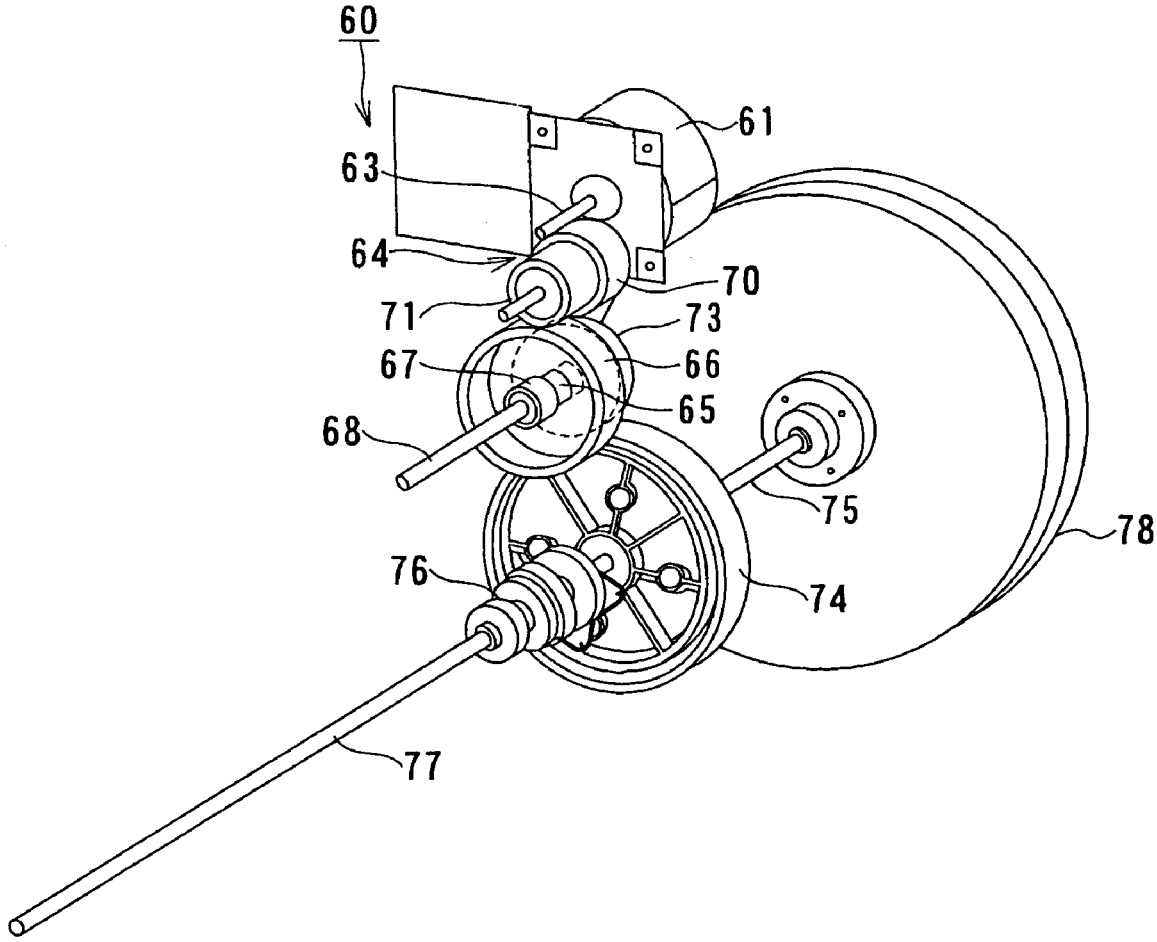
FIG. 3 is a schematic perspective view showing the revolving body drive unit.

The photoreceptor drum 12 and the intermediate transfer belt 13 are driven by a revolving body drive unit 60 shown in FIG. 2 and FIG. 3. The revolving body drive unit 60 is disposed on the rear side of the MFP apparatus A and has a common drive motor 61 as a drive source of the photoreceptor drum 12 and the intermediate transfer belt 13. As the drive motor 61, a servo motor with less rotational oscillations, a stepping motor with minute steps, a DC brushless motor or the like may be used.

An output shaft 62 of the drive motor 61 constitutes a motor revolving shaft, and a motor drive gear 63 is provided as a single unit with, or integrally on, the motor output shaft 62, and the motor drive gear 63 meshes with an intermediate driven gear 66 as the belt drive gear provided on the belt drive shaft 65 via a reduction gear mechanism 64 which constitute a multi-stage reduction gear train. The belt drive shaft 65 is, as shown in FIG. 3, connected to a roller supporting shaft 68 via a belt drive coupling 67. The roller supporting shaft 68 supports the drive roller 36 of the intermediate transfer belt 13 so as to rotate integrally. The belt drive shaft 65 and the roller supporting shaft 68 constitute the roller revolving shaft of the intermediate transfer belt 13.

The multi-stage reduction gear mechanism 64 constitutes a first-stage reduction gear train by a driven gear 70 which meshes with the motor drive gear 63. The intermediate drive gear 71 integrally provided with the driven gear 70 and the intermediate driven gear 66 which meshes with the drive gear 71 constitute a second-stage intermediate reduction gear train. The intermediate driven gear 66 serves as a belt drive gear for rotating the drive roller 36 of the intermediate transfer belt 13.

The intermediate driven gear 66 of the intermediate reduction gear train is integrally provided with a final-speed drive gear 73. The final-stage drive gear 73 directly meshes with a final-stage driven gear 74, and the final-stage reduction gear train is constituted as a reduction gear train for driving the photoreceptor drum 12. In this manner, the belt drive gear 66 meshes with the drum drive gear 74 as a driven gear via the drive gear 73. The drum drive gear 74 is mounted to the drum drive shaft 75. In FIG. 2, the respective gears of the multi-stage reduction gear train which constitute the reduction gear mechanism 64 are represented by pitch circles of chain lines.

The drum drive shaft 75 is provided with a drum drive coupling 76 on the front side, and is connected to a drum supporting shaft 77 via the coupling 76. The drum drive shaft 75 and the drum supporting shaft 77 constitute the drum revolving shaft. A flywheel 78 which has a large moment of inertia is provided on the rear side of the drum revolving shaft 75 so as to rotate integrally. The flywheel 78 is formed of disk-shaped metal steel plate such as zinc or the like. The drum supporting shaft 77 integrally supports the photoreceptor drum 12, and the photoreceptor drum 12 is rotationally driven by the rotational drive of the drum drive shaft 75. Rotational driving of the photoreceptor drum 12 is stably and smoothly performed by the moment of inertia of the flywheel 78 which is mounted to the drum drive shaft 75 without causing uneven rotation.

In the revolving body drive unit 60, the belt drive gear 66 for driving the intermediate transfer belt 13 and the final-stage drive gear 73 are integrally formed and constitute the second gear, which is mounted to the belt drive shaft 65. The final-stage drive gear 73 mounted to the belt drive shaft 65 meshes directly with the drum drive gear (final-stage driven gear, the first gear) 74 mounted to the drum drive shaft 75. In addition, with the drum drive shaft 75 holding the flywheel 78, drum driving of the photoreceptor drum 12 is stabilized, and the intermediate transfer belt 13, which is driven on the upstream side of drum driving of the photoreceptor drum 12, can be belt driven with the effect of inertia of the flywheel 78, whereby the amount of inertia of the belt driving can be increased and stabilized.

In the photoreceptor drive unit 60, the belt drive gear 73 (66) of the intermediate transfer belt 13 and the drum drive gear 74 of the photoreceptor drum 12 meshes directly with each other via the reduction gear mechanism 64, and the flywheel 78 is mounted to the drum drive shaft 75 of the photoreceptor drum 12. Consequently, rotation of both of the drum driving of the photoreceptor drum 12 and the belt driving of the intermediate transfer belt 13 are synchronized, and both of them share the effect of the flywheel (effect of inertia), thereby stabilizing the rotational driving.

In addition, by driving the photoreceptor drum 12, which is rotated at a high reduction gear ratio, at a reduced speed on the downstream side of the belt drive gear 66 (73), which drives the intermediate transfer belt 13, the speed reduction gear mechanism 64 from the drive motor 61 to the photoreceptor drum 12 can join the multi-stage reduction gear train at a gradual speed reduction ratio.

In this revolving body drive unit 60, the motor output of the drive motor 61 is transmitted to the belt drive gear (intermediate driven gear, the fourth gear) 66 and the final-stage drive gear (second gear) 73, and the final-stage drive gear 73, is then transmitted to the drum drive gear (first gear) 74 by meshing the final-stage drive gear 73 directly with the drum drive gear (first gear), so as to drive the intermediate transfer belt 13 and the photoreceptor drum 12 respectively. The belt drive gear 66 may be composed of the reduction gear train instead of the intermediate driven gear.

The respective gears of the reduction gear train are composed of a helical gear formed of resin by injection molding or the like. The gear material may be polyacetal resin superior in dimensional stability, self lubricating property and molding property, synthetic resin with low thermal expansion such as polyimide or polycarbonate, resin obtained by filling glass reinforcing fiber to polycarbonate to improve strength or rigidity, or polycarbonate blended with fluorine contained resin to improve the self lubricating property.

When the respective gears in the reduction gear train are helical gear, gear oscillation due to meshing can be reduced and hence gear noise can be reduced by holding down the gear module to 0.5 or below, or by setting the gear meshing width of the reduction gear train to the range from 12 mm to 25 mm, preferably to about 18 mm in production. With the helical gear having a gear meshing width of more than 25 mm, an accurate draft angle cannot be obtained and hence molding of the gear is difficult. When the gear meshing width is less than 12 mm, it is difficult to hold down the gear oscillation.

Subsequently, the operation of the apparatus for producing images according to the invention will be described.

When the apparatus for producing images 10 is activated, the charging unit 16 charges the drum surface of the photoreceptor drum 12 uniformly.

A laser beam LB is irradiated from the laser optical unit 17 on the surface of the photoreceptor drum 12 charged to a required potential uniformly by the charging unit 16 according to the image information to produce an electrostatic latent image thereon. The image information is supplied from host equipment such as a host computer or a personal computer (not shown).

On the other hand, the electrostatic latent image produced on the drum surface is subsequently developed by the developing unit 18 and a toner image of a predetermined color is produced.

More specifically, the electrostatic latent image is developed by the developing unit 21 for black toner and a toner image of black toner is produced. When the developing unit 21 for black toner is in developing operation, the developing unit 22 for color toner is kept to a state apart from the drum surface of the photoreceptor drum 12.

The black toner image produced on the photoreceptor drum 12 is primarily transferred onto the intermediate transfer belt 13.

After having completed the primary transfer, the toner remaining on the drum surface of the photoreceptor drum 12 is cleaned and removed by the drum cleaning unit 15.

This operation is repeated by the number of required colors, and consequently, a full color toner image is produced on the intermediate transfer belt 13. The full color toner image is sent to the position of the secondary transfer, where the secondary transfer is carried out onto the transfer paper which is fed through the traveling path 53.

The transfer roll 50 of the secondary transfer unit 51 is kept apart from the intermediate transfer belt 13 while the overlapping operation of the primarily transferred toner image on the intermediate transfer belt 13 is carried out.

After having completed the secondary transfer, the toner remaining on the intermediate transfer belt 13 is cleaned by the belt cleaning unit 44. The transfer paper on which the secondary transfer is completed is fed to the fixing unit 56 through the traveling path 53. The fixing unit 56 heats and pressurizes the toner image by a pair of heat rolls to fix the toner image to the transfer paper.

The transfer paper on which the toner image is fixed is sent along the traveling path 53, and is discharged onto the paper discharge tray 58 through a guiding gate 57 in sequence and is accumulated on the paper discharge tray 58.

Figure 4:
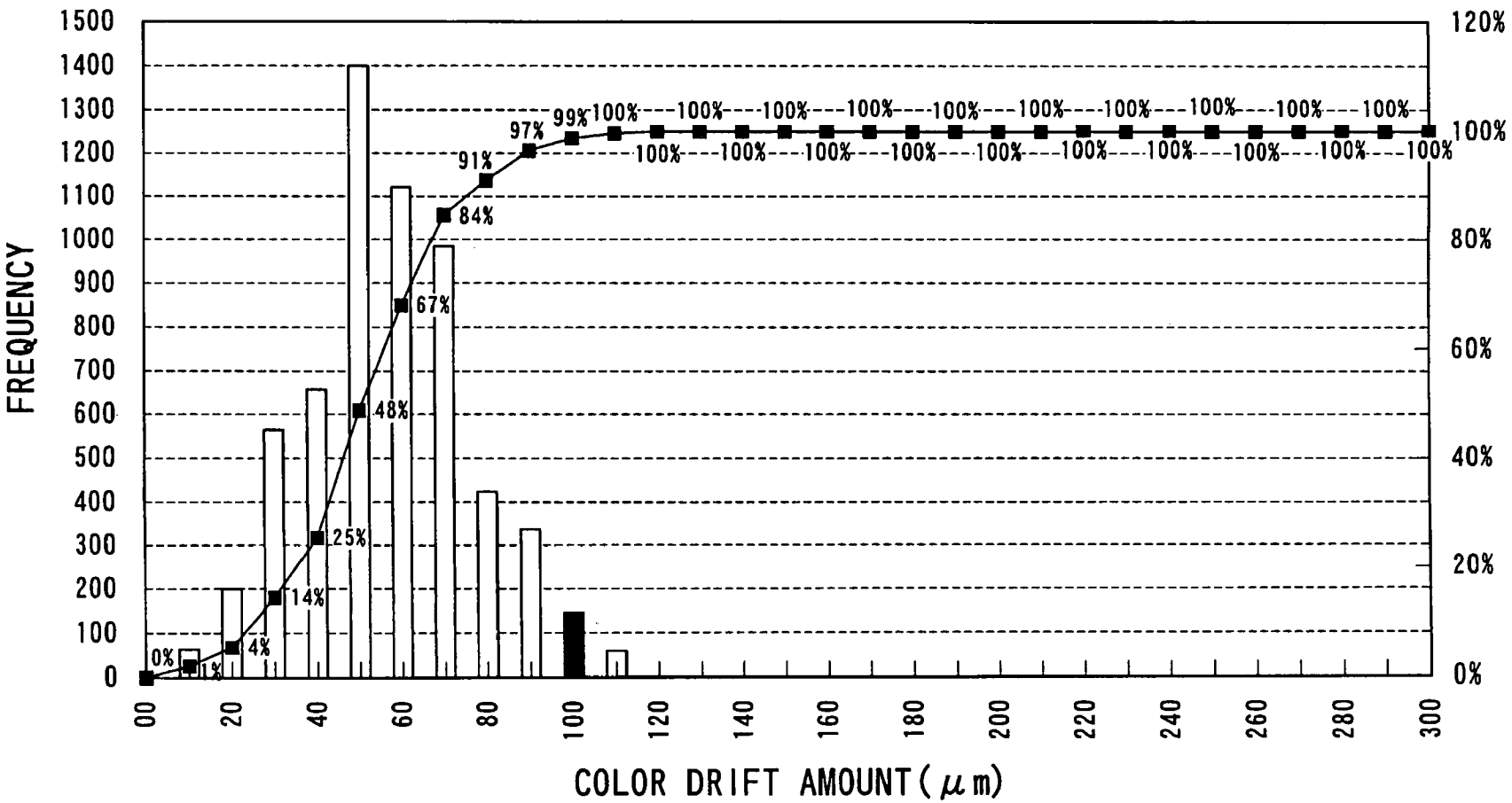
FIG. 4 is a drawing showing a histogram of color drift amount of an output image using the revolving body drive unit.

FIG. 4 is a drawing showing a histogram of color drift amount of an output image in the case of the apparatus for producing images 10 according to the invention using the revolving body drive system. In FIG. 4, a bar graph represents statistic frequency of occurrence of color drift of the output image by the amount. In the measurement test of 6000 times in parameter, the frequency of occurrences of color drift of the amount of 50 μm is about 1400, which is the maximum, and the color drift of the amount exceeding 110 μm did not occur at all, whereby it was found that the color drift amount is quite small.

Figure 5:
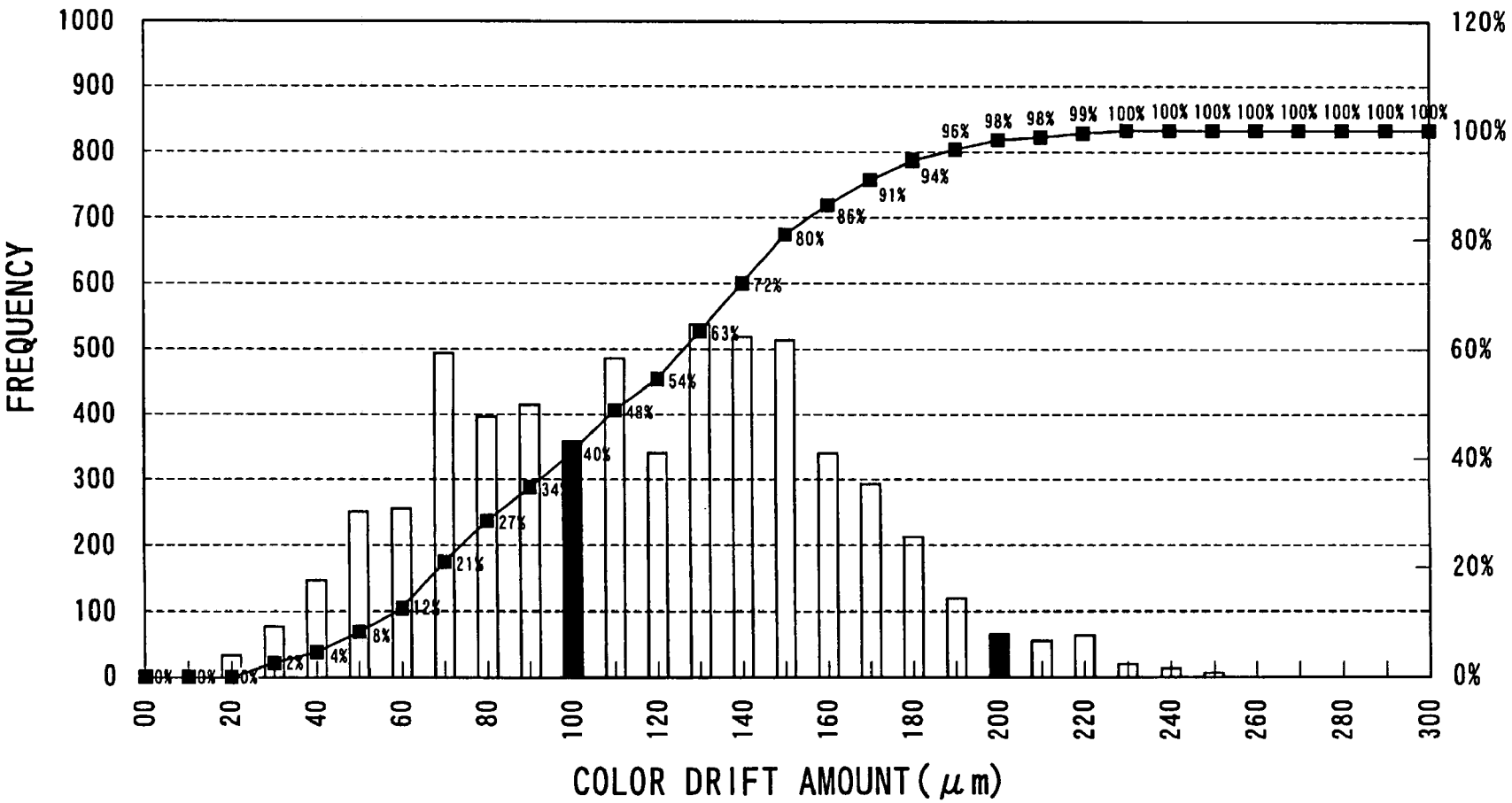
FIG. 5 is a drawing showing a histogram of color drift amount of an output image using a revolving body drive unit in the related art.
Figure 6:
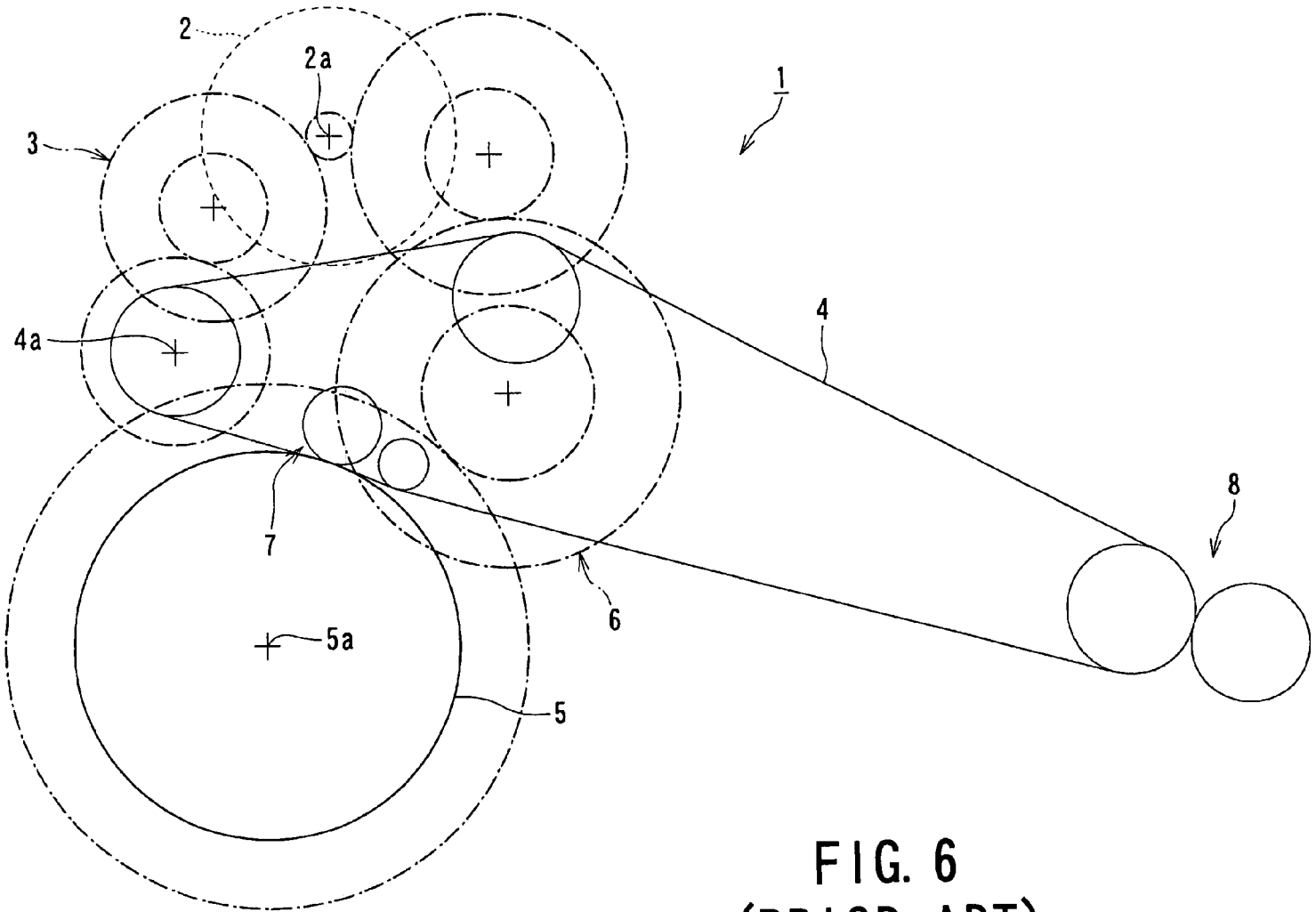
FIG. 6 (PRIOR ART)
FIG. 6 is a schematic drawing of a general revolving body drive unit provided in the apparatus for producing images in the related art.

On the other hand, FIG. 5 is a drawing showing a histogram of color drift amount of an output image in the case where the general revolving body drive unit 1 shown in FIG. 6 is used. The bar graph in FIG. 5 corresponds to the bar graph shown in FIG. 4, and the measurement test of 6000 times showed a statistic frequency of about 400 to 500 times of color drift amount in the range from 70 μm to 150 μm, whereby it was found that the color drift amount is varied and the color drift amount is significant.

It was found that the color drift amount of the output image was significantly smaller than that of the conventional revolving body drive unit 1 by driving the intermediate transfer belt 13 and the photoreceptor drum 12 synchronously using the reduction gear train as in the case of the apparatus for producing images 10 of the invention, whereby the color drift more than 100 μm does not occur on the output image.

In this revolving body drive unit 60, it was found that the drum driving could be stabilized to achieve smooth rotation by mounting the flywheel 78 to the drum drive shaft 75 of the photoreceptor drum 12, while the belt driving of the intermediate transfer belt 13 on the upstream side of the reduction gear train could be stabilized with a small variation in revolving speed owing to the inertia effect of the flywheel 78.

In addition, since the revolving body drive unit 60 is configured of one system reduction gear mechanism 64, the gear structure can be simplified, and assembly of the reduction gear mechanism 64 is facilitated. In addition, the manufacturing cost can be reduced, and weight reduction, noise reduction, longer operating life are achieved.

Although an example of driving the photoreceptor drum and the intermediate transfer belt by the revolving body drive unit provided with the multi-stage reduction gear mechanism has been described in conjunction with the embodiment of the invention, it is also possible to drive the drive roll of the intermediate transfer belt directly by the drive motor, provide the drum drive gear on the belt drive shaft for driving the drive roll, construct the reduction gear mechanism by the drum driven gear which is directly meshed with the drum drive gear, and rotationally drive the photoreceptor drum.

Although an example in which the developing unit for black toner is provided independently from the developing unit for color toner is shown as the embodiment of the invention, it is also possible to constitute the developing unit for respective colors including black by a rotary system. In this case, the toner capacity of the developer for black toner, which is used by a larger amount than other colors, may be changed according to the ratio of the average amount of use.

What is claimed is:

1. An apparatus for producing images comprising:

a photoreceptor drum having a drum surface on which electrostatic latent images are produced and a flywheel attached to the revolving shaft of the photoreceptor drum;

a developing unit for developing the electrostatic latent images on the photoreceptor drum by predetermined toner;

a primary transfer unit having a transfer roller for transferring a toner image produced on the photoreceptor drum to an intermediate transfer belt;

a secondary transfer unit having a secondary transfer roller for transferring the transferred toner image produced on the intermediate transfer belt to a recording medium;

an intermediate transfer unit having the intermediate transfer belt and a drive roller for driving the intermediate transfer belt to circulate the intermediate transfer belt between the drive roller and the secondary transfer roller; and a revolving body drive unit for driving the drive roller and the photoreceptor drum by a series of gears, wherein the revolving body drive unit comprises:

a motor for driving the drive roller and the photoreceptor drum;

a motor drive gear attached to the shaft of the drive motor;

an intermediate drive gear driven by the motor drive gear;

a belt drive gear attached to the shaft of the drive roller and driven by the intermediate drive gear; and a drum drive gear attached to the revolving shaft of the photoreceptor drum and driven by the belt drive gear, the motor drive gear, the intermediate drive gear, the belt drive gear, and the drum drive gear are configured so as to rotate at gradually decreasing rotation speeds, and the transfer roller of the primary transfer unit is disposed between the drive roller and the secondary transfer roller, and pressed against the surface of the photoreceptor drum so that the intermediate transfer belt passes through between the transfer roller and the photoreceptor drum.

2. The apparatus for producing images according to claim 1, wherein the modules of the drum drive gear of the photoreceptor drum and the belt drive gear of the drive roller are as low as 0.5 or below.

3. The apparatus for producing images according to claim 1, wherein the revolving body drive unit comprises a helical gear having a gear meshing width in the range from 12 mm to 25 mm.

4. An apparatus for producing images comprising:

a photoreceptor drum having a drum revolving shaft, a first gear, and a flywheel respectively attached to the drum revolving shaft;

a primary transfer unit having a transfer roller for transferring a toner image produced on the photoreceptor drum to an intermediate transfer belt;

a secondary transfer unit having a secondary transfer roller for transferring the transferred toner image on the intermediate transfer belt to a recording medium;

an intermediate transfer unit having the intermediate transfer belt and a drive roller having a second gear on the shaft thereof and for driving the intermediate belt to circulate the intermediate transfer belt between the drive roller and the secondary transfer roller;

a drive motor having a third gear on a motor revolving shaft; and a fourth gear for transmitting an output from the drive motor to the second gear by the third gear, wherein the first gear and the second gear are directly meshed with each other, the transfer roller of the primary transfer unit is disposed between the drive roller and the secondary transfer roller, and pressed against a surface of the photoreceptor drum so that the intermediate transfer belt passes through between the transfer roller and the photoreceptor drum.

5. The apparatus for producing images according to claim 4, wherein the third gear the fourth gear, the second gear, and the first gear are configured so as to rotate at gradually decreasing rotation speeds.

6. The apparatus for producing images according to claim 5, wherein the revolving shaft of the photoreceptor drum and the revolving shaft of the drive roller are coupled to the first gear and the second gear via output couplings respectively.

7. The apparatus for producing images according to claim 5, wherein at least the photoreceptor drum, the drive roller, and the intermediate transfer belt constitute a unit, and the unit can be drawn out from the front side of a body casing.

8. The apparatus for producing images according to claim 4, wherein the revolving shaft of the photoreceptor drum and the revolving shaft of the drive roller are coupled with the first gear and the second gear via couplings, respectively.

9. The apparatus for producing images according to claim 4, wherein at least the photoreceptor drum, the drive roller, and the intermediate transfer belt constitute a unit, and the unit can be drawn out from the front side of the apparatus for producing images.

10. The apparatus for producing images according to claim 4, wherein the fourth gear comprises a helical gear.

* * * * *